United States Patent [19]

Hegedus

[11] 4,212,176

[45] Jul. 15, 1980

[54] AUTOMOBILE TRUNK LOCK SECURITY DEVICE

[76] Inventor: Charles C. Hegedus, 121 Macleod Ct., Conyers, Ga. 30207

[21] Appl. No.: 910,674

[22] Filed: May 30, 1978

[51] Int. Cl.[2] ..... E05B 17/00

[52] U.S. Cl. ..... 70/417

[58] Field of Search ..... 70/416, 417, DIG. 43, 70/240; 292/346; 85/33, 51

[56] References Cited

U.S. PATENT DOCUMENTS

| | | | |
|---|---|---|---|
| 1,847,058 | 2/1932 | Yanchenko | 85/51 |
| 1,852,186 | 4/1932 | Nonneman | 85/51 |

FOREIGN PATENT DOCUMENTS

| | | | |
|---|---|---|---|
| 2507049 | 9/1975 | Fed. Rep. of Germany | 70/417 |

*Primary Examiner*—Robert L. Wolfe
*Attorney, Agent, or Firm*—Robert B. Kennedy

[57] ABSTRACT

A security device for an automobile trunk having a cylinder lock mounted within an opening in the trunk lid with a lock stem extending inwardly from the lid into a keyway of a trunk latch housing. The security device comprises a block defining a central aperture mounted snuggly about the cylinder lock overlaying the inside surface of the trunk lid about the trunk opening. A resilient mounting plate is mounted to the block and to the trunk lid. The block serves to inhibit prying of the lock outwardly from the trunk lid to expose and gain access to the trunk latch housing keyway through the trunk lid opening while the resilient mounting plate prevents the cylinder lock from falling and exposing the trunk latch housing keyway should the lock be pried inwardly.

3 Claims, 6 Drawing Figures

AUTOMOBILE TRUNK LOCK SECURITY DEVICE

BACKGROUND OF THE INVENTION

Automobile trunks are today most commonly locked by means of a key operated cylinder lock mounted within an opening in the trunk lid outer wall which has a lock stem that extends inwardly into a rotatable keyway of a latch housing that is operatively linked with the trunk latch. Thieves and pilferers however all too often break into such trunks by inserting a wedge shaped tool or screwdriver between the cylinder lock and its lid mount and exerting leverage on the lock. In this manner the cylinder lock may either be forced inwardly or pried outwardly from the trunk lid. In the event the thief is successful in prying the cylinder lock outwardly the rotatable keyway will become exposed through the now vacant opening in the trunk lid. The thief may then easily insert an elongated tool such as a screwdriver through the lid opening and into the rotatable keyway and rotate the keyway key and thus operate the latch. Alternatively, in the event the thief is successful in forcing the cylinder lock inwardly the lock may then fall downwardly pulling the lock stem with it out of the keyway and similarly exposing the rotatable keyway through the vacant opening in the lid.

In order to prevent the aforementioned action of thieves automobile trunk lock security devices have been heretofore provided such as those disclosed in U.S. Pat. Nos. 3,740,980 and 4,041,741. In the former patent a tubular sleeve constructed of a durable material is mounted so as to encase the cylinder lock stem and the opening in the latch mechanism. In the latter patent an inner and outer plate is sandwiching about the exterior wall of the trunk lid about the periphery of the cylinder lock. The outer plate inhibits one from punching a hole in the trunk lid in the vicinity of the lock to manipulate the latch while the inner plate inhibits one from punching the lock inwardly. These devices, however, may be rather easily circumvented. For example, the provision of a tubular sleeve about the lock stem does not inhibit one from prying the cylinder lock outwardly. In such an event the sleeve merely accompanies and rides upon the lock stem until it either falls off of the stem or is itself pulled out with the lock through the trunk lid opening. The provision of two plates sandwiches about the inner and outer surfaces of the trunk lid wall fails to inhibit one from taking a tool and twisting the entire lock cylinder itself thereby causing the trunk latch to operate. Furthermore, the presence of a plate on the exterior of the trunk often proves unattractive in appearance.

Accordingly, it is a general object of the present invention to provide an improved automobile trunk lock security device.

More specifically, it is an object of the invention to provide a security device for a cylinder lock mounted to an automobile trunk lid.

Another object of the invention is to provide a security device of the type described which bidirectionally inhibits axial movement of the cylinder lock.

Yet another object of the invention is to provide a security device of the type described which is of simple and economic construction and which may be readily mounted in place.

SUMMARY OF THE INVENTION

In a preferred form of the invention a security device is provided for an automobile trunk having a cylinder lock mounted within an opening in the trunk lid with a lock stem extending inwardly from the lid into a keyway of a trunk latch housing. The security device comprises a block defining a central aperture mounted snuggly about the cylinder lock overlaying the inside surface of the trunk lid about the trunk opening. The block serves to inhibit prying of the lock outwardly from the trunk lid to expose and gain access to the trunk latch housing keyway through the trunk lid opening. A resilient mounting plate may also be secured to the block and to the trunk lid to maintain the cylinder lock and block over the keyway in the event the cylinder lock is pushed inwardly from its mount.

DESCRIPTION OF THE PREFERRED EMBODIMENTS

Figures 1, 2, 3:
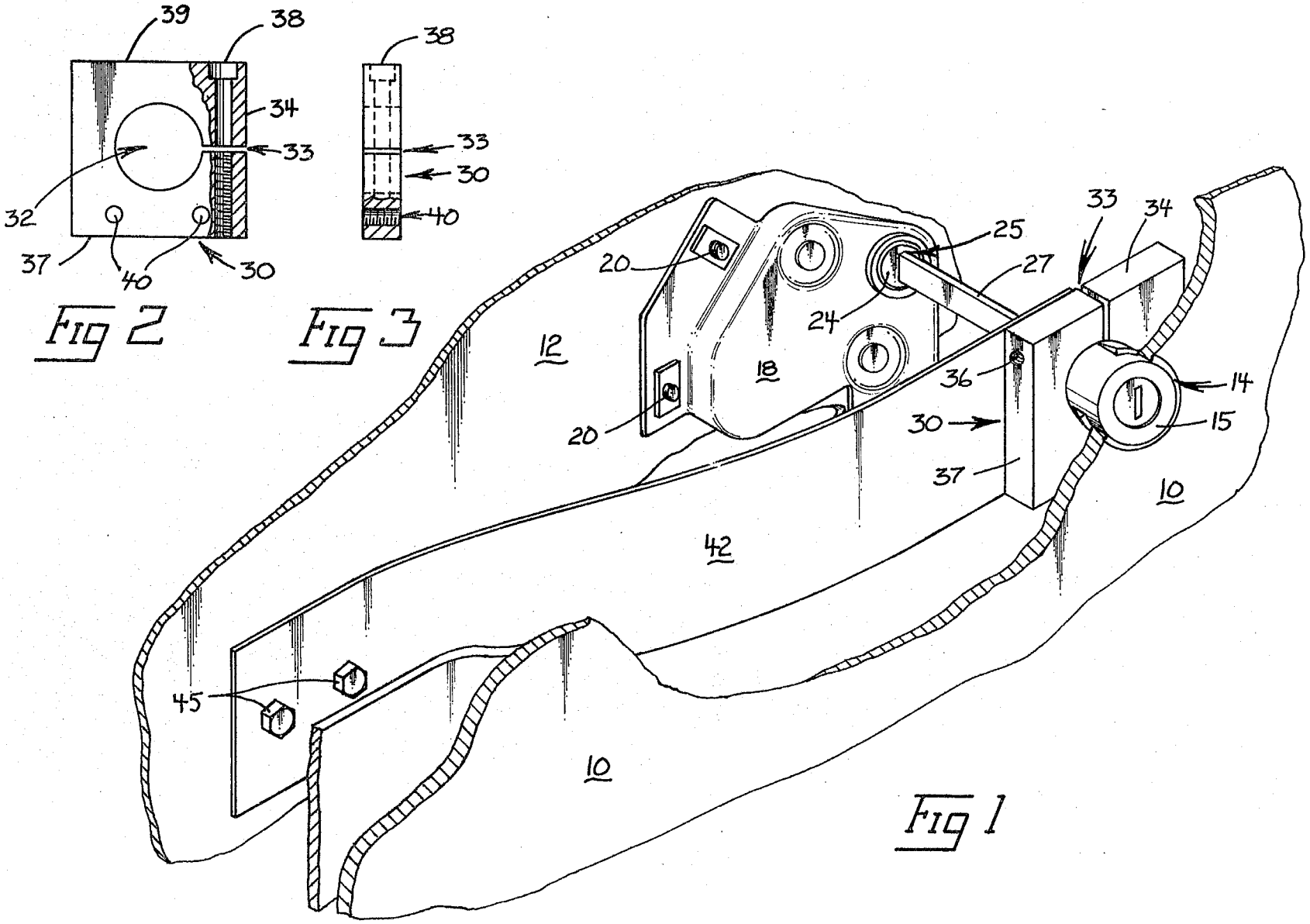
FIG. 1 is a perspective view of an automobile trunk lock security device embodying principles of the invention in one preferred form.
FIG. 2 is a front elevational view of the block component of the security device shown in FIG. 1 with a portion of the block shown in cross-section to reveal internal details.
FIG. 3 is a side elevational view of the block shown in FIG. 1 also with a portion of the block shown in cross-section to reveal interior structure.
Figure 4:
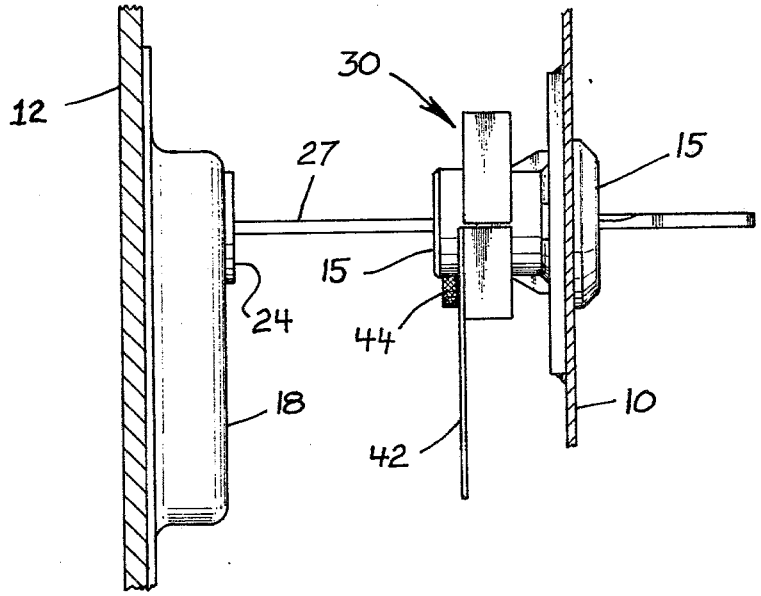
FIG. 4 is a plan view of the automobile trunk lid security device shown in FIG. 1.
Figure 5:
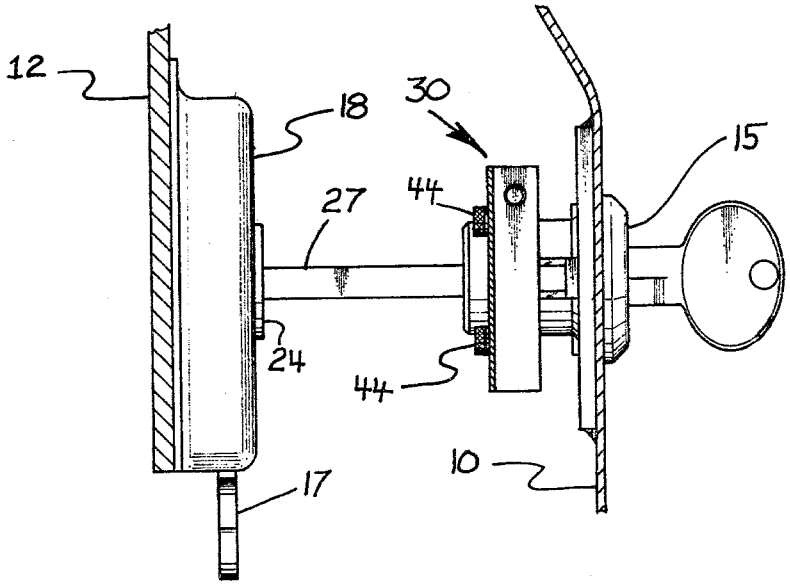
FIG. 5 is a side elevational view of the security device shown in FIG. 1.

Referring now in more detail to the drawing, there is shown in FIGS. 1-5 a portion of an automobile trunk lid of double wall construction having an outer wall 10 and an inner wall 12 with a cylindrical opening 14 formed through the outer wall in which a cylinder lock 15 is mounted. The trunk is provided with a latch mechanism 17 that depends out of the bottom of a latch housing 18 which is mounted by screws 20 to the inner trunk lid wall 12. A key 24 is rotatably mounted within the latch housing which defines a keyway or slot 25. A lock stem 27 extends rearwardly from the cylinder lock 15 into the keyway 25. The key 24 is coupled with latch mechanism 17 to actuate upon rotary movement of the key in unlatching the trunk lid from the main body of the trunk. All of these just described components of the automobile trunk lid, cylinder lock and latch assembly are conventional.

To inhibit an unauthorized person from gaining access to the trunk by prying the cylinder lock 15 inwardly or outwardly from the trunk lid opening 14 a block 30 is provided having a central annular aperture 32 and a slot 33 extending from the central aperture to one peripheral side 34 of the block. A threaded channel 36 extends from the peripheral side 37 of the block to slot 33 while a countersunk channel 38 extends from the opposed block side 39 to the slot coaxially the threaded channel 36. A pair of threaded holes 40 also extend between opposed principle surfaces of the block.

A resilient, metallic mounting plate in the form of elongated spring steel strip 42 is secured flush to block 30 parallel lid outer wall 10 by a pair of screws threaded into holes 40 and through aligned holes formed in the mounting plate. The mounting plate 42 is also secured by screws 45 to the trunk lid inner wall 12. With this mounting it is seen that the resilient mounting plate is bowed so as to spring bias the mounting block 30 and cylinder lock 15 inwardly towards the latch key 24.

The device serves to provide security to the trunk in the following manner. In the event a thief were to insert a tool into lid opening 14 and to exert outward leverage on the cylinder lock the presence of block 30 overlaying that portion of the inside surfaces of lid outer wall 10 bordering the opening 14 inhibits any outward movement of the cylinder lock due to is abuttment with the lid outer wall. Conversely, should the thief force the cylinder lock inwardly and completely out of lid opening 14, the mounting plate 42 causes the cylinder lock and block 30 to spring to a position flush over the key 24 and keyway 25. Thus, in either event the theif will not be able to gain access to the keyway 25 so as to be able to insert a tool therein to rotate key 24 and thereby operate the latch mechanism 17.

Figure 6:
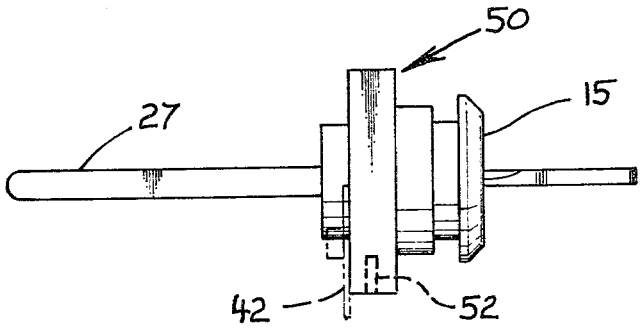
FIG. 6 is a side elevational view of a security device for an automobile trunk embodying principles of the invention in an alternative form.

With reference next to FIG. 6 the security device is shown in a slightly modified form. Here the device includes a mounting block 50 that again is secured to a mounting plate 42 with the block fitted snuggly about the cylinder lock 15. In this case, however, instead of being provided with a slot the block is provided with a channel 52 oriented radially the cylindrical lock which itself is provided with a coextensive threaded channel. The block is mounted to the lock by passing a set screw through the channel 52 and into the cylinder lock channel.

It should be understood that still other modifications may be made and that the just described embodiments merely illustrate principles of the invention in two forms. Thus, many modifications, additions, and deletions may be made thereto without departure from the spirit and scope of the invention as set forth in the following claims.

I claim:

1. A security device for an automobile trunk having a trunk lid of double wall construction with a lid opening fromed in an outer wall and with a trunk latch housing mounted on an inner wall, and a cylinder lock mounted within the outer wall opening having a lock stem extending inwardly from the lid into a keyway of the trunk latch housing, and with the security device comprising a block defining a central aperture mounted snuggly about the cylinder lock overlaying the inside surface of the trunk lid about the lid outer wall opening whereby prying of the lock outwardly from the trunk lid to expose and gain access to the trunk latch housing keyway through the trunk lid opening is inhibited by the block: and a resilient mounting plate mounted on the trunk lid inner wall and to said block spring biasing said mounting block towards the latch housing whereby prying of the lock inwardly into the trunk to enable the cylinder lock to fall and expose the trunk latch housing keyway is inhibited by the mounting plate by maintaining the lock and block over the keyway.

2. A security device for an automobile trunk in accordance with claim 1 wherein said block is split by a slot extending from the block periphery to said central aperture, and wherein said block further defines a threaded groove oriented transverse said slot into which a threaded bolt may be received in mounted the block snuggly about the cylinder lock.

3. A security device for an automobile trunk in accordance with claim 1 wherein said mounting block is provided with a threaded groove extending from the block periphery to said central aperture and a set screw threaded received in said groove in setting engagement with the cylinder lock.

* * * * *